US005544704A

United States Patent [19]

Laurel et al.

[11] Patent Number: 5,544,704

[45] Date of Patent: Aug. 13, 1996

[54] DRILLABLE WHIPSTOCK

[75] Inventors: David F. Laurel; James F. Heathman, both of Duncan, Okla.; Kenneth P. Marcel, Lafayette, La.

[73] Assignee: Halliburton Company, Duncan, Okla.

[21] Appl. No.: 409,378

[22] Filed: Mar. 23, 1995

[51] Int. Cl.[6] ..... E21B 7/08

[52] U.S. Cl. ..... 166/117.6; 175/80

[58] Field of Search ..... 166/117.6, 382; 175/79, 80, 81, 82, 61

[56] References Cited

U.S. PATENT DOCUMENTS

| | | | |
|---|---|---|---|
| 2,386,514 | 10/1945 | Stokes | 175/81 |
| 2,509,144 | 5/1950 | Grable et al. | 166/117.6 X |
| 3,397,746 | 8/1968 | Link | 166/117.6 |
| 5,115,872 | 5/1992 | Brunet et al. | 175/61 |
| 5,188,190 | 2/1993 | Skaalure | 175/81 X |
| 5,287,921 | 2/1994 | Blount et al. | 166/117.6 |
| 5,314,015 | 5/1994 | Streich et al. | 166/184 |
| 5,398,754 | 3/1995 | Dinhoble | 166/117.6 |
| 5,437,340 | 8/1995 | Lee et al. | 166/117.6 X |

*Primary Examiner*—Hoang C. Dang

*Attorney, Agent, or Firm*—Craig W. Roddy; Stephen R. Christian; Anthony L. Rahhal

[57] ABSTRACT

A whipstock for use in sidetrack drilling operations in a well bore. The whipstock has a whipstock case with a whipstock body disposed therein. The whipstock is to be comprised of a drillable material so that after the whipstock has been set, the well bore can be re-opened simply by drilling through the whipstock. The whipstock body is preferably comprised of high compressive strength cement. The whipstock: also includes an offset mandrel attached to the whipstock: case. The whipstock mandrel has a whipstock bore and may have an inflation packer attached to a lower end thereof. The inflation packer is actuated through the whipstock bore to seal against the well bore and anchor the whipstock in place.

24 Claims, 5 Drawing Sheets

DRILLABLE WHIPSTOCK

BACKGROUND OF THE INVENTION

This invention relates to an apparatus for assisting directional drilling in a well bore. More specifically, this invention relates to a drillable whipstock with an offset mandrel through which an anchoring means for the whipstock can be actuated.

During the drilling of a well for the production of the well and/or gas, it is often desirable to drill a directional hole, or well bore, through the side of the original well bore. Such sidetracking operations are performed for several reasons, such as avoiding, or drilling around drilling equipment which has become stuck in the original well bore. In addition, such operations make it possible to drill several wells from the original well bore. In such cases, it is often desirable to re-open the original well bore for the production of oil and gas therethrough.

Many sidetracking operations involve setting a cementitious kickoff plug of approximately 50–500 feet in length at the location to be sidetracked. Sidetrack plugs are typically set by lowering an open ended tubing string into the well bore and pumping a cementitious fluid through the tubing string and out the open end. Pressure in the well bore forces the cementitious fluid up the annulus between the tubing string and the well bore. The cementitious fluid is displaced until a sidetrack or kickoff plug of a desired length is set. The sidetracking operation then generally comprises using a bent sub to drill into the sidetrack plug and into side of the well bore. When such an operation is performed in an open, as opposed to a cased hole, directional drilling does not always successfully penetrate the side of the well bore. Such failures are partially due to the fact that the integrity of the cement is comprised during the setting of the plug due to mud contamination. Various other mechanical reasons can cause difficulty in penetrating the side of the well bore.

Other directional drilling techniques include setting a whipstock in a well bore. A whipstock has an inclined upper face, or ramp, which directs a drill bit into the side of the original well bore. A prior art method for setting a whipstock in a well bore is described in U.S. Pat. No. 5,287,921 to Blount et al. Typically, whipstocks are comprised of a non-drillable material such as steel. Therefore, to re-open the original well bore, the whipstock must be removed.

The present invention solves these problems by providing a whipstock which can be used in an open or a cased well bore, and which is comprised of a drillable material so that the well bore can be re-opened after sidetrack drilling operations have commenced.

SUMMARY OF THE INVENTION

The whipstock of the present invention comprises a whipstock case having an upper edge and a lower edge. A whipstock body, or body portion, is disposed in the whipstock case.. The whipstock body includes an upper end and a lower end, with an inclined whipstock ramp defined at the upper end of the body portion. The invention may further include a whipstock mandrel which extends through the body portion. The mandrel has a mandrel bore, or central bore defined therethrough.

The whipstock mandrel may further comprise an offset mandrel having an upper portion, a center portion and a lower portion, the upper and lower portion being vertically coaxial and the central portion being laterally offset from the upper and lower portion. Thus, the upper mandrel portion may include a longitudinal central axis which is coincident with a longitudinal central axis of the lower mandrel portion. The center mandrel portion may comprise a longitudinal center axis, which is laterally offset from the longitudinal central axis of the upper mandrel portion and the lower mandrel portion.

The whipstock case may also include a long side and a short side, and the whipstock mandrel may be attached to the long side or the short side of the whipstock case. The whipstock may also include a stiffening means to prevent buckling or straightening of the offset mandrel when an axial load is applied. The stiffening means may comprise an upper stiffener attached to the upper portion and the center portion of the mandrel, and a lower stiffener attached to the lower portion and the center portion of the mandrel.

The invention may further include an anchoring means operably associated with the whipstock mandrel, so that the anchoring means is actuated to engage the side of the well bore through the mandrel, thereby anchoring the whipstock in the well bore. The anchoring means may comprise an inflation packer apparatus connected to the mandrel.

The inflation packer apparatus may have a central flow passage disposed therethrough which is communicated with the mandrel bore, and may include an inflatable packer bladder. The central flow passage is communicated with the packer bladder so that an inflation fluid may be displaced through the whipstock mandrel and the central flow passage into the packer bladder, thereby inflating the bladder and anchoring the whipstock in the well bore. Thus, the whipstock comprises a means for actuating the anchoring means so that the anchoring means engages the side of the well bore. More specifically, the whipstock comprises a means for actuating the inflation packer, so that the packer bladder inflates and engages the side of the well bore. Once the whipstock is anchored, a cementitious fluid may be circulated in the well bore above the packer bladder until it encases the whipstock.

After the whipstock has been set, directional drilling operations may begin. Those operations may include lowering a drill pipe with a bent sub and a drill bit attached thereto into the well. The drill bit will kick off of the whipstock ramp into the side of the well bore.

The whipstock is to be comprised of a drillable material so that after the whipstock has been set, the well bore can be re-opened by drilling through the whipstock. Thus, the whipstock body may be comprised of a high compressive strength cement which will direct a drill bit into the side of a well bore, but which is also a drillable material.

Thus, it is an object of the invention to provide a whipstock which will assist directional drilling procedures to achieve an almost 100 percent success rate on the first attempt. Another object of the present invention is to provide a whipstock which is drillable so that after the whipstock has been set, the well bore can be re-opened without removing the whipstock.

A further object of the present invention is to provide a whipstock with an offset mandrel to maximize the surface of the whipstock ramp. Another object is to provide a whipstock with a mandrel which allows an anchoring means attached therebelow to be actuated through the mandrel.

Additional objects and advantages of the invention will become apparent as the following detailed description of the preferred embodiments is read in conjunction with accompanying drawings which illustrate such preferred embodiments.

BRIEF DESCRIPTION OF THE DRAWINGS

FIG. 3 is a section view through line 3—3 of the embodiment of. FIG. 1.

DETAILED DESCRIPTION OF THE INVENTION

Figure 1:
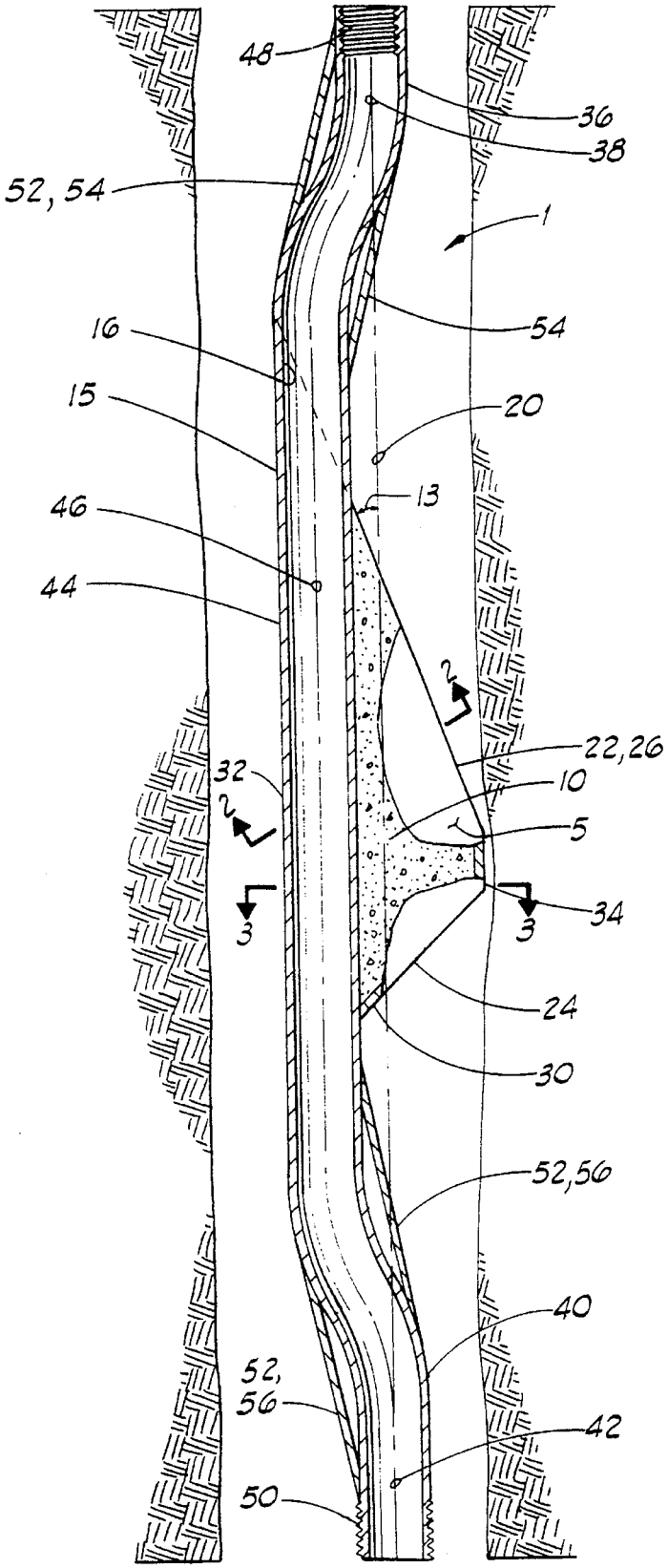
FIG. 1 is a cross-sectional view of the whipstock of the present invention.
Figure 2:
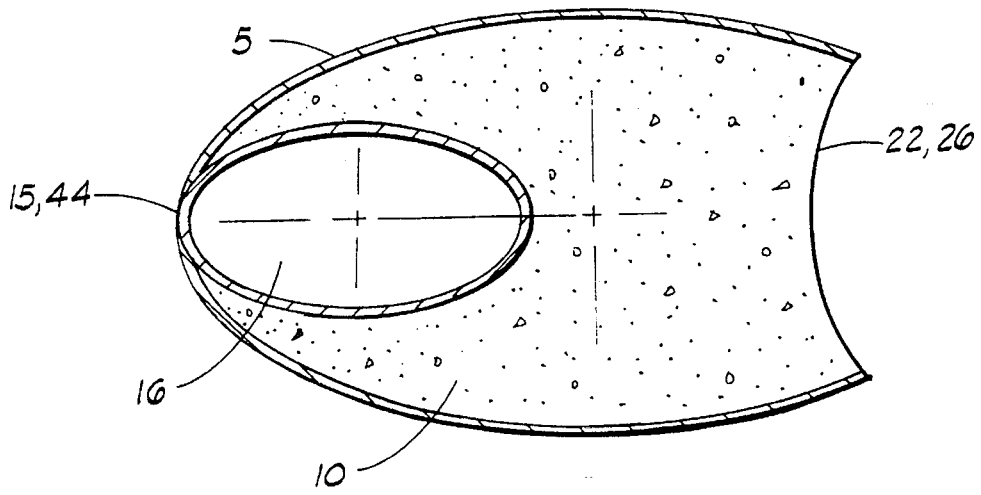
FIG. 2 is a section view through line 2—2 of the embodiment of FIG. 1.

Referring to FIG. 1, whipstock 1 of the present is shown. Whipstock 1 includes a whipstock case, or outer case 5. A whipstock body, or body portion, 10 is disposed in the whipstock case, and a whipstock mandrel 15 extends through the whipstock body 10. The whipstock case and whipstock mandrel may be comprised of a drillable material, such as, but not limited to, aluminum, composites, plastic and fiberglass, so that after the whipstock has been set in the well bore, the well bore can be re-opened simply by drilling through the whipstock. The whipstock body is likewise comprised of a drillable material, such as high compressive strength cement. Whipstock body 10 has a longitudinal central axis 20, an upper end 22, and a lower end 24. An inclined whipstock ramp 26 is defined at upper end 22. An angle 13 is defined between longitudinal central axis 20 and ramp 26. Angle 13 is preferably 1 to 5 degrees and is more preferably 1 to 3 degrees. Angle 13 is shown in the drawings as greater than the actual angle for purposes of clarity. Upper end 22 preferably comprises a concave surface as better shown in FIG. 2.

Whipstock case 5 has a bottom end cap 30, a long side 32 and a short side 34. Whipstock mandrel 15, which has a whipstock bore, or mandrel bore 16, is an offset mandrel which comprises an upper portion 36 having a longitudinal central axis 38, a lower portion 40 having a longitudinal central axis 42, and a center portion 44 having a longitudinal central axis 46. Longitudinal central axis 38 of upper portion 36 and longitudinal central axis 42 of lower portion 40 are coincident. Therefore, upper portion 36 and lower portion 40 of the mandrel are coaxial. Longitudinal central axis 46 of center portion 44 is laterally offset from longitudinal central axes 38 and 42. Thus, central portion 44 is laterally offset from upper portion 36 and lower portion 40.

Mandrel 15 has an inner thread 48 disposed at upper portion 36 and is thus adapted to be connected to a string of tubing thereabove. Mandrel 15 also includes a lower outer thread 50 and is adapted to be connected to an anchoring means therebelow. Mandrel 15 also includes a stiffening means 52 which may include a plurality of upper stiffeners 54 affixed to the upper portion 36 and central portion 44 of the mandrel. Stiffening means 52 may also include a plurality of lower stiffeners 56 attached to the lower portion 40 and the central portion 44 of the mandrel 15. The stiffening means will prevent buckling or straightening when an axial load is applied to the whipstock. As shown in FIG. 1, the mandrel extends through whipstock body 10, and is attached to whipstock case 5. More specifically, center portion 44 is attached to and forms a portion of long side 32 of whipstock case 5.

Figure 3:
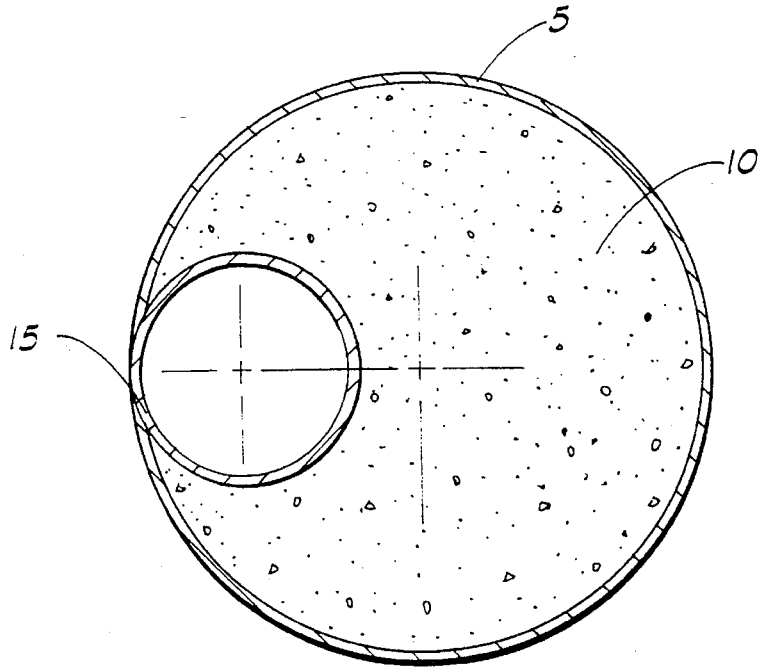
Figure 4:
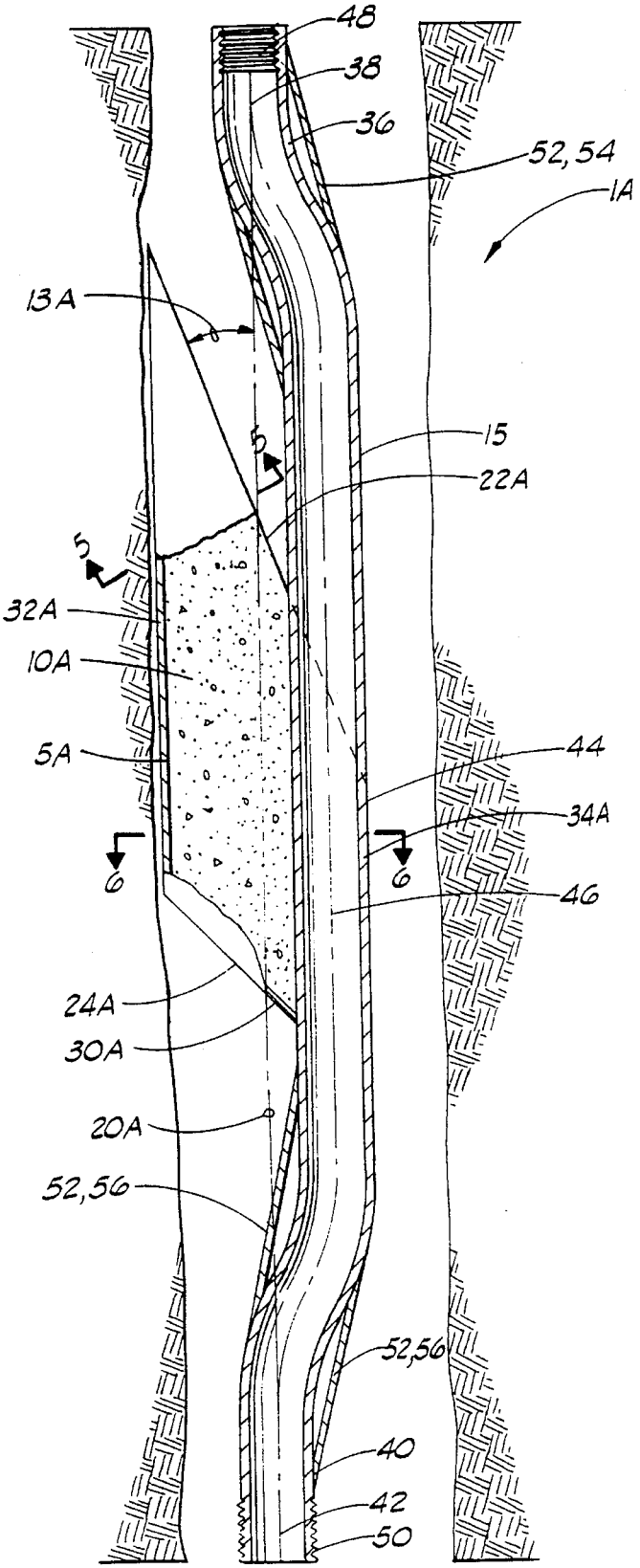
FIG. 4 is a cross section of an alternative embodiment of the present invention.
Figure 5:
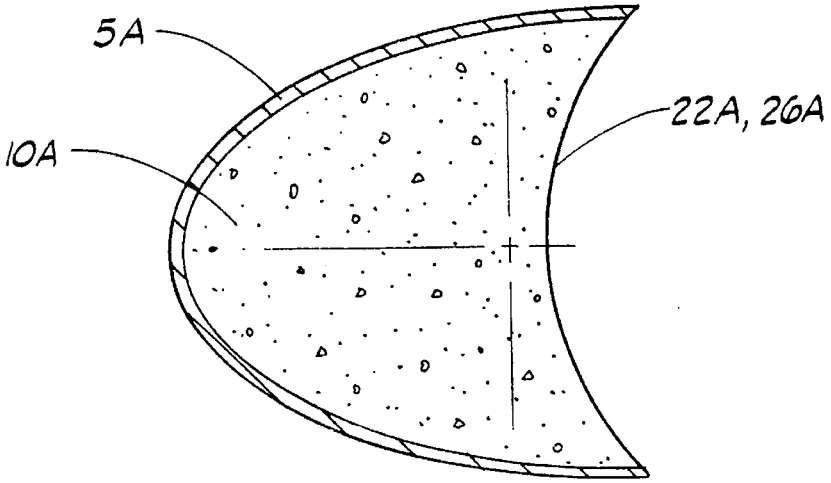
FIG. 5 is a section view through line 5—5 of the embodiment shown in FIG. 4.
Figure 6:
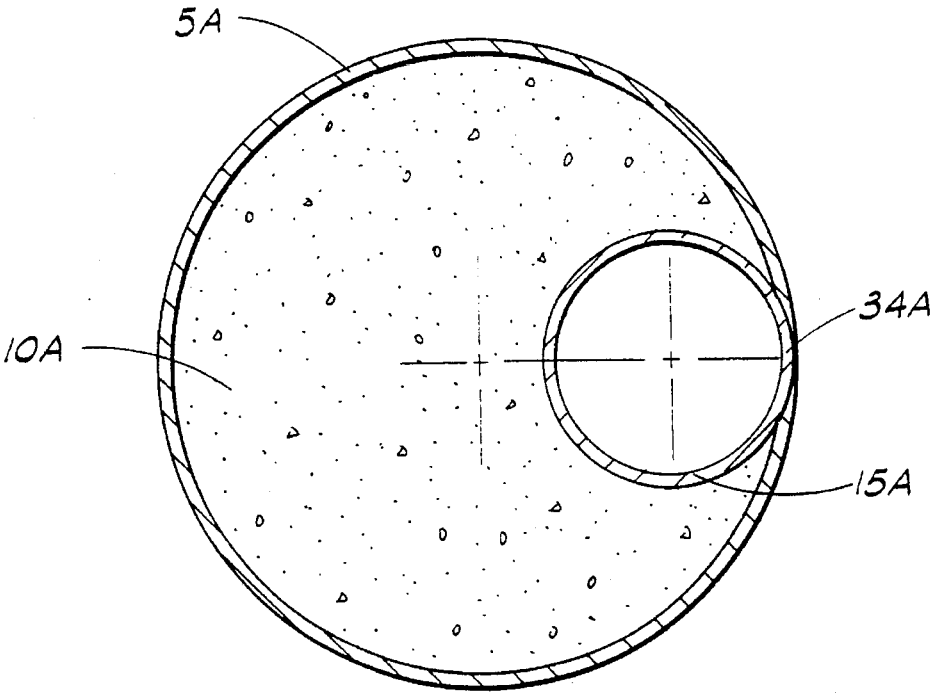
FIG. 6 is a section view through line 6—6 of the embodiment shown in FIG. 4.

An additional embodiment of the present invention is shown in FIG. 4. The embodiment shown in FIG. 4 is similar to that shown in FIG. 1 except that in FIG. 4, the invention has been modified so that the whipstock mandrel is attached to the short side of the whipstock case. The features that have been modified in the embodiment shown in FIG. 4 are designated by the suffix A. Thus, the whipstock shown in FIG. 4 is designated by the numeral 1A. Whipstock 1A includes outer case 5A, a whipstock body 10A and a whipstock mandrel 15. Whipstock body 10A has a longitudinal central axis 20A, an upper end 22A and a lower end 24A. Whipstock ramp 26A is defined at upper end 22A of whipstock body 10A. Upper end 22A, as better shown in FIG. 5, preferably comprises a concave surface. An angle 13A is defined between axis 20A and whipstock ramp 26A. Angle 13A is preferably 1 to 5 degrees and more preferably 1 to 3 degrees. Angle 13A is depicted in the drawings as greater than the actual angle for purposes of clarity. Whipstock case 5A includes a bottom end cap 30A, a long side 32A and a short side 34A. The mandrel shown in the invention in FIG. 3 is identical to the mandrel shown in the embodiment shown in FIG. 1. However, the mandrel has been rotated 180 degrees and is attached to and forms a part of the short side of whipstock case 5A. Upper portion 36 and lower portion 40 of whipstock mandrel 15 are vertically coaxial with body portion 10A.

Figure 7:
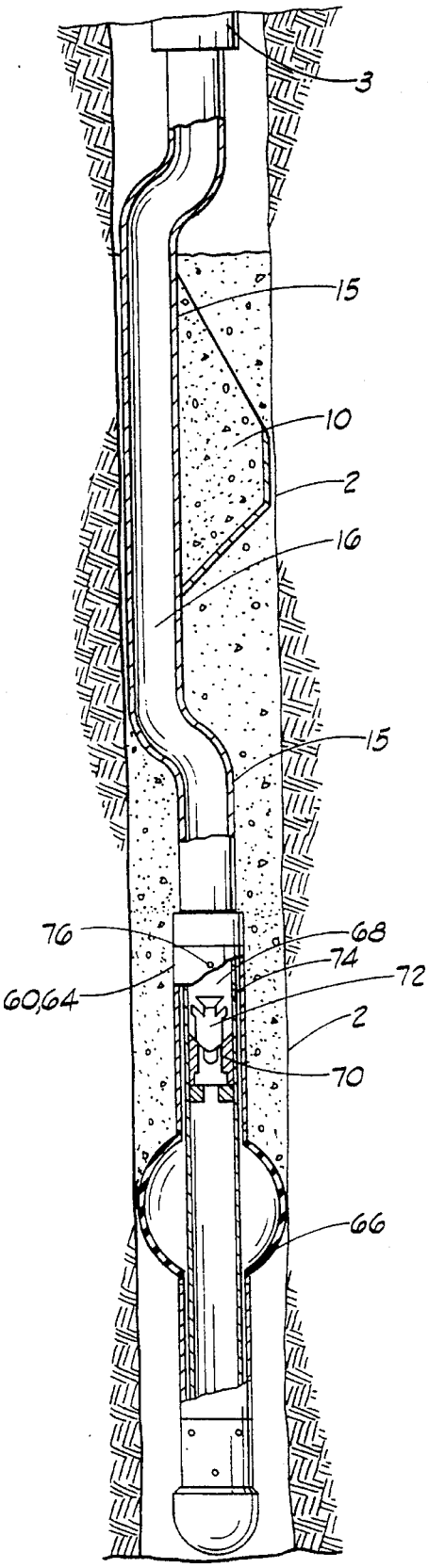
FIG. 7 is a schematic of the present invention with an anchoring means attached thereto.

As shown in the schematic in FIG. 7, the invention further includes an anchoring means 60. Anchoring means 60, like whipstock 1, is to be constructed of a drillable material so that well bore 2 can be re-opened simply by drilling through the whipstock and anchoring means after the whipstock has been set in the well bore. Anchoring means 60 is connected to the lower portion of mandrel 15 and is operably associated with the mandrel such that the anchoring means may be actuated through tile whipstock to engage the side of well bore 2 and to anchor the whipstock in place. Anchoring means 60 may include, but is not limited to, an inflation packer apparatus 64. The inflation packer apparatus 64 may be of any type of inflation packer known in the art which utilizes a shutoff dart or ball to actuate the packer and is to be constructed of drillable materials. Inflation packer 64 may thus include a central flow passage 68. The inflation packer also includes a packer bladder 66 disposed about the central flow passage. Typically., fluid flow from the central flow passage to the inflatable packer bladder is initially obstructed with a shut off plug, or with an opening sleeve, or other means known in the art. Flow is established between central flow passage 68 and packer bladder 66 by dropping a shutoff ball through the tubing string which opens communication between the packer bladder and the central flow passage, and which blocks flow through central flow passage 68 and directs flow into packer bladder 66.

In the schematic shown in FIG. 7, the inflation packer includes an opening sleeve 70. Sleeve 70 is initially positioned to prevent flow into packer bladder 66. A shutoff ball 72 dropped through mandrel bore 16 and into central flow passage 68 engages sleeve 70, and as pressure in the string is increased, sleeve 70 moves downward and flow to packer bladder 66 through an inflation port 74 is established. The inflation packer may further include a pressure relief valve 76 or other pressure relief means known in the art, so that after packer bladder 66 is inflated a cementitious fluid may be displaced into the well bore 2 through valve 76. Once bladder 66 is inflated, pressure in the tubing string will increase and flow to the well bore through valve 76 will be established, and cementitious fluid can be displaced and circulated into the well bore until the whipstock is encased.

Clearly, any type of inflation packer which utilizes a shutoff ball to establish flow to the packer bladder may be used with the whipstock of the present invention. Whipstock mandrel 15 is thus operably associated with the anchoring means so that the anchoring means can be actuated to engage the sides of the well bore and to anchor the whipstock through the whipstock bore.

METHOD OF OPERATION

Figure 8:
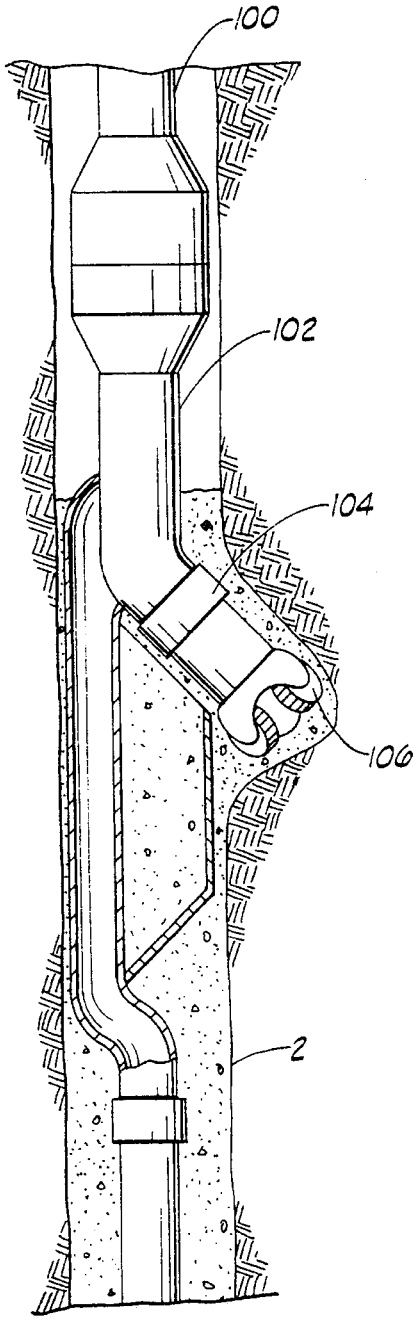
FIG. 8 is a schematic of the present invention after the whipstock has been set.

Referring again to FIG. 7, the whipstock of the present invention is secured to tubing string 3 and lowered into a well bore. Anchoring means 60 is attached to the lower portion 40 of whipstock mandrel 15. After the tubing string has been lowered to the desired depth, a shut off plug is dropped through the tubing string and passes through whipstock bore 16 into central flow passage 68, thus opening communication between central flow passage 68 and bladder 66. An inflation fluid is then pumped through whipstock bore 16 into packer bladder 66 until it engages the side of well bore 2. A cementitious fluid may then be displaced through the whipstock bore and into the central flow passage. Pressure is increased until the central flow passage is communicated with the well bore. Cementitious fluid is then circulated into the well bore until it encases the whipstock. After the whipstock is encased, directional drilling operations can then begin. As shown in FIG. 8, such an operation may include lowering a drill string 100 including a bent sub 102, a drill motor 104 and a drill bit 106 into the well. The drill bit 106 will kick off of whipstock ramp 26 into the side of well bore 2. If desired, the drill string including the bent sub can then be removed, and the well bore can be re-opened by simply drilling through the whipstock and the anchoring means.

It will be seen therefore that the drillable whipstock of the present invention is well adapted to carry out the ends and advantages mentioned as well as those inherent therein. While the present embodiments of the apparatus are illustrated for the purpose of this disclosure, numerous changes in the construction and arrangement of parts may be made by those skilled in the art. All such changes are encompassed within the scope and spirit of the appended claims.

What is claimed is:

1. A whipstock apparatus for assisting directional drilling in a well bore, comprising:

a whipstock case;

a whipstock body disposed in said whipstock case, said whipstock body having an upper end and a lower end;

an inclined whipstock ramp defined at said upper end of said whipstock body;

a whipstock mandrel attached to said whipstock case, said whipstock mandrel having an upper portion, a center portion and a lower portion, wherein said upper portion and said lower portion are coaxial and wherein said central portion is laterally offset from said upper and lower portions; and wherein said whipstock case includes a long side and a short side, and wherein said center portion of said whipstock mandrel is attached to said long side of said whipstock case.

2. The apparatus of claim 1, wherein said whipstock mandrel, said whipstock case, said whipstock body and said whipstock ramp are comprised of a drillable material so that the well bore can be re-opened after said whipstock has been set in the well bore.

3. The apparatus of claim 2, wherein said whipstock body is comprised of cement.

4. The apparatus of claim 1, further comprising:

a central bore defined in said whipstock mandrel; and an inflation packer apparatus connected to said lower portion of said whipstock mandrel, wherein said whipstock mandrel includes means for actuating said inflation packer apparatus so that said packer seals against the well bore.

5. The apparatus of claim 4, wherein said inflation packer apparatus includes means for anchoring said whipstock in the well bore.

6. The apparatus of claim 1, further comprising: stiffening means for preventing said whipstock mandrel from straightening or buckling when an axial load is applied thereto.

7. The apparatus of claim 6, wherein said stiffening means comprises:

an upper stiffener attached to said upper portion and said center portion of said mandrel; and a lower stiffener attached to said lower portion and said center portion of said mandrel.

8. A whipstock apparatus for assisting directional drilling in a well bore, comprising:

a whipstock case;

a whipstock body disposed in said whipstock case, said whipstock body having an upper end and a lower end;

an inclined whipstock ramp defined at said upper end of said whipstock body;

a whipstock mandrel attached to said whipstock case, said whipstock mandrel having an upper portion, a center portion and a lower portion, wherein said upper portion and said lower portion are coaxial and wherein said central portion is laterally offset from said upper and lower portions; and wherein said whipstock case includes a long side and a short side, and wherein said center portion of said whipstock mandrel is attached to said short side of said whipstock case.

9. The apparatus of claim 8, wherein said whipstock mandrel, said whipstock case, said whipstock body and said whipstock ramp are comprised of a drillable material so that the well bore can be re-opened after said whipstock has been set in the well bore.

10. The apparatus of claim 9, wherein said whipstock body is comprised of cement.

11. The apparatus of claim 8, further comprising:

a central bore defined in said whipstock mandrel; and an inflation packer apparatus connected to said lower portion of said whipstock mandrel, wherein said whipstock mandrel includes means for actuating said inflation packer apparatus so that said packer seals against the well bore.

12. The apparatus of claim 11, wherein said inflation packer apparatus includes means for anchoring said whipstock in the well bore.

13. The apparatus of claim 8, further comprising: stiffening means for preventing said whipstock mandrel from straightening or buckling when an axial load is applied thereto.

14. The apparatus of claim 13, wherein said stiffening means comprises:

an upper stiffener attached to said upper portion and said center portion of said mandrel; and a lower stiffener attached to said lower portion and said center portion of said mandrel.

15. A whipstock apparatus for assisting directional drilling in a well bore, comprising:

a whipstock case;

a whipstock body disposed in said whipstock case, said whipstock body having an upper end and a lower end;

an inclined whipstock ramp defined at said upper end of said whipstock body;

a whipstock mandrel attached to said whipstock case, said whipstock mandrel having an upper portion, a center portion and a lower portion, wherein said upper portion and said lower portion are coaxial and wherein said central portion is laterally offset from said upper and lower portions;

stiffening means for preventing said whipstock mandrel from straightening or buckling when an axial load is applied thereto, said stiffening means includes:

an upper stiffener attached to said upper portion and said center portion of said mandrel, and a lower stiffener attached to said lower portion and said center portion of said mandrel.

16. The apparatus of claim 15, wherein said whipstock mandrel, said whipstock case, said whipstock body and said whipstock ramp are comprised of a drillable material so that the well bore can be re-opened after said whipstock has been set in the well bore.

17. The apparatus of claim 16, wherein said whipstock body is comprised of cement.

18. The apparatus of claim 15, further comprising:

a central bore defined in said whipstock mandrel; and an inflation packer apparatus connected to said lower portion of said whipstock mandrel, wherein said whipstock mandrel includes means for actuating said inflation packer apparatus so that said packer seals against the well bore.

19. The apparatus of claim 18, wherein said inflation packer apparatus includes a means for anchoring said whipstock in the well bore.

20. An apparatus for assisting in drilling into a side of a well bore, comprising:

(a) a whipstock, said whipstock including:

an outer case;

a body portion disposed in said outer case;

an inclined ramp defined at an upper end of said body portion;

(b) a mandrel extending through said body portion, said mandrel having a mandrel bore defined therethrough; wherein said mandrel includes:

an upper mandrel portion having a longitudinal central axis;

a lower mandrel portion having a longitudinal central axis, said longitudinal central axis of said lower mandrel portion being coincident with said longitudinal central axis of said upper mandrel portion;

a center mandrel portion having a longitudinal central axis, said longitudinal central axis of said center mandrel portion being laterally offset from said longitudinal central axis of said upper mandrel portion and said lower mandrel portion;

wherein said center mandrel portion is attached to said outer case, and wherein said longitudinal central axis of said upper mandrel portion and said lower mandrel portion are coincident with a longitudinal central axis of said body portion; and (c) anchoring means operably associated with said mandrel, so that said anchoring means may be actuated to engage the side of the well bore through said mandrel bore, thereby anchoring said whipstock in the well bore.

21. The apparatus of claim 20, wherein said anchoring means includes an inflation packer apparatus connected to said mandrel.

22. The apparatus of claim 21, further comprising:

a central flow passage disposed in said inflation packer apparatus, said central flow passage being communicated with said mandrel bore; and an inflatable packer bladder disposed about said central flow passage, said whipstock being operably associated with said inflation packer wherein communication between said central flow passage and said inflatable packer bladder is established through said mandrel bore, so that an inflation fluid may be displaced through said mandrel and said central flow passage into said packer bladder, thereby inflating said packer bladder and anchoring said whipstock in the well bore.

23. The apparatus of claim 20, wherein the apparatus is comprised of a drillable material so that the well bore can be reopened after said whipstock has been anchored therein.

24. The apparatus of claim 23, wherein said body portion of said whipstock is comprised of cement.

* * * * *